US011202952B2

(12) United States Patent
Hagel

(10) Patent No.: US 11,202,952 B2
(45) Date of Patent: Dec. 21, 2021

(54) CORNER SUPPORT BAR (CSB) IN A TRAMPOLINE

(71) Applicant: Avero AB, Gothenburg (SE)

(72) Inventor: Thomas Hagel, Uddevalla (SE)

(73) Assignee: Avero AB, Gothenburg (SE)

( * ) Notice: Subject to any disclaimer, the term of this patent is extended or adjusted under 35 U.S.C. 154(b) by 45 days.

(21) Appl. No.: 16/750,391

(22) Filed: Jan. 23, 2020

(65) Prior Publication Data

US 2020/0238119 A1 Jul. 30, 2020

Related U.S. Application Data

(60) Provisional application No. 62/797,214, filed on Jan. 26, 2019, provisional application No. 62/797,215, (Continued)

(51) Int. Cl.
*A63B 71/00* (2006.01)
*A63B 5/11* (2006.01)
(Continued)

(52) U.S. Cl.
CPC ..... *A63B 71/0054* (2013.01); *A63B 5/11* (2013.01); *A63B 21/023* (2013.01);
(Continued)

(58) Field of Classification Search
CPC ..... A63B 5/11; A63B 21/0428; A63B 21/023; A63B 21/4033; A63B 71/0054; A63B 71/023; A63B 71/022; A63B 2071/0063; A63B 2071/009; A63B 2209/00; A63B 2208/12
See application file for complete search history.

(56) References Cited

U.S. PATENT DOCUMENTS

X504038 8/1893 Judson
X652617 6/1900 Holtz
(Continued)

FOREIGN PATENT DOCUMENTS

AU 2015202862 A1 12/2015
AU 2017200402 A1 2/2017
(Continued)

OTHER PUBLICATIONS

International search report for PCT/EP2017/057961.
(Continued)

*Primary Examiner* — Megan Anderson
(74) *Attorney, Agent, or Firm* — AWA Sweden AB; Thomas L. Ewing

(57) ABSTRACT

Embodiments of the invention provide a plurality of support bars that may be fitted to the corner of a trampoline frame to provide increased stiffness for the trampoline frame. The support bars may be placed over or in the vicinity of the trampoline's legs to create a zone of increased stiffness. The support bars may also serve as an entry point to the trampoline such that the trampoline user need not stand on the trampoline's suspension system (e.g., helical springs) in order to enter the trampoline. The user may be protected from the support bars by the use of an edge pad filled with an energy absorbing material.

18 Claims, 11 Drawing Sheets

Related U.S. Application Data filed on Jan. 26, 2019, provisional application No. 62/797,216, filed on Jan. 26, 2019.

(51) Int. Cl.

| | |
|---|---|
| ***A63B 21/04*** | (2006.01) |
| ***A63B 21/00*** | (2006.01) |
| ***A63B 21/02*** | (2006.01) |
| ***A63B 71/02*** | (2006.01) |

(52) U.S. Cl.

CPC ..... *A63B 21/0428* (2013.01); *A63B 21/4033* (2015.10); *A63B 71/023* (2013.01); *A63B 2071/009* (2013.01); *A63B 2071/0063* (2013.01); *A63B 2209/00* (2013.01)

(56) References Cited

U.S. PATENT DOCUMENTS

| | | | | |
|---|---|---|---|---|
| 2,370,990 | A | 3/1945 | Nissen | |
| 3,546,721 | A | 12/1970 | Cleary | |
| 4,433,838 | A | 2/1984 | Gordon | |
| 4,900,011 | A | 2/1990 | Nolet | |
| 5,385,518 | A | 1/1995 | Turner | |
| 5,399,132 | A | 3/1995 | Bailey | |
| D382,618 | S | 8/1997 | Gift | |
| 5,665,040 | A | 9/1997 | Ho | |
| 5,700,232 | A | 12/1997 | Clausen et al. | |
| 5,776,003 | A | 7/1998 | Kenny | |
| 5,911,535 | A | 6/1999 | Gvolch | |
| 6,053,845 | A | 4/2000 | Publicover et al. | |
| 6,129,649 | A | 10/2000 | Yang | |
| 6,206,811 | B1 | 3/2001 | Lat | |
| 6,261,207 | B1 | 7/2001 | Publicover | |
| 6,319,174 | B1 | 11/2001 | Alexander | |
| 6,607,468 | B1 | 8/2003 | Nichols et al. | |
| 6,672,997 | B1 | 1/2004 | Winkler | |
| 6,676,576 | B1 | 1/2004 | Wu | |
| 6,866,617 | B2 | 3/2005 | Chen | |
| D536,405 | S | 2/2007 | Freeman | |
| 7,481,740 | B2 | 1/2009 | Colling | |
| 7,678,024 | B2 | 3/2010 | Alexander | |
| 7,708,667 | B2 | 5/2010 | Alexander | |
| 7,758,471 | B2 | 7/2010 | Nelson | |
| 7,850,575 | B1 | 12/2010 | Hsiang | |
| 7,854,687 | B2 | 12/2010 | Alexander | |
| D630,285 | S | 1/2011 | Hsiang | |
| 8,105,211 | B2 | 1/2012 | Alexander | |
| 8,303,469 | B2 | 11/2012 | Alexander | |
| 8,430,795 | B2 | 4/2013 | Publicover | |
| 8,650,724 | B2 | 2/2014 | King | |
| 8,764,610 | B2 | 7/2014 | Chen | |
| 8,790,221 | B2 | 7/2014 | Schaffer | |
| RE45,182 | E | 10/2014 | Nelson | |
| 8,905,898 | B2 | 12/2014 | Chen | |
| 8,920,290 | B2 | 12/2014 | Stokes | |
| 9,339,676 | B2 | 5/2016 | Publicover | |
| D759,773 | S | 6/2016 | Miller | |
| 9,486,658 | B2 | 11/2016 | Alexander | |
| 9,545,532 | B2 | 1/2017 | Miller | |
| 9,656,110 | B2 | 5/2017 | Alexander | |
| 9,700,748 | B2 | 7/2017 | Howe | |
| D794,150 | S | 8/2017 | Ji | |
| D794,151 | S | 8/2017 | Ji | |
| 9,873,009 | B2 | 1/2018 | Miller | |
| D850,554 | S * | 6/2019 | Hagel | D21/797 |
| 10,780,334 | B2 * | 9/2020 | Nilsson | A63B 1/00 |
| 2002/0137598 | A1 | 9/2002 | Publicover et al. | |
| 2004/0121883 | A1 | 6/2004 | Publicover | |
| 2005/0032609 | A1 | 2/2005 | Nissen | |
| 2005/0245370 | A1 | 3/2005 | Boland | |
| 2005/0075223 | A1 | 4/2005 | Wu | |
| 2005/0187082 | A1 | 8/2005 | Bowser | |
| 2005/0239618 | A1 | 10/2005 | Teng | |
| 2005/0255976 | A1 | 11/2005 | Hinds et al. | |
| 2006/0025289 | A1 | 2/2006 | Wallach | |
| 2006/0089240 | A1 | 4/2006 | Yu | |
| 2007/0000182 | A1 | 1/2007 | Boujon | |
| 2007/0004560 | A1 | 1/2007 | Nelson | |
| 2008/0009394 | A1 | 1/2008 | Van Elverdinghe | |
| 2009/0111659 | A1 | 4/2009 | Xiang | |
| 2009/0276984 | A1 | 11/2009 | Rabe | |
| 2011/0256985 | A1 | 10/2011 | Mann | |
| 2014/0069757 | A1 | 3/2014 | Schlipper | |
| 2014/0221162 | A1 | 8/2014 | Chen | |
| 2014/0371031 | A1 | 12/2014 | Allen | |
| 2015/0045188 | A1 | 2/2015 | Allen | |
| 2017/0128779 | A1 | 5/2017 | Howe et al. | |
| 2017/0173376 | A1 | 6/2017 | Miller et al. | |
| 2017/0361155 | A1 | 12/2017 | McGrane et al. | |
| 2019/0060692 | A1 | 2/2019 | Chang | |
| 2020/0238120 | A1 * | 7/2020 | Hagel | A63B 21/023 |
| 2020/0238152 | A1 * | 7/2020 | Hagel | A63B 71/022 |

FOREIGN PATENT DOCUMENTS

| | | | |
|---|---|---|---|
| CA | 2808984 | A1 | 9/2013 |
| CA | 2896049 | A1 | 12/2016 |
| CN | 1277592 | C | 10/2006 |
| CN | 200957263 | Y | 10/2007 |
| CN | 101102821 | A | 1/2008 |
| CN | 101332348 | A | 12/2008 |
| CN | 201848045 | U | 6/2011 |
| CN | 202237001 | U | 5/2012 |
| CN | 202446713 | U | 9/2012 |
| CN | 201147592 | Y | 11/2012 |
| CN | 202666263 | U | 1/2013 |
| CN | 202876183 | U | 4/2013 |
| CN | 302552501 | S | 8/2013 |
| CN | 203525194 | U | 4/2014 |
| CN | 101918085 | A | 5/2014 |
| CN | 103826707 | A | 5/2014 |
| CN | 103889512 | A | 6/2014 |
| CN | 204261253 | U | 4/2015 |
| CN | 105358223 | A | 2/2016 |
| CN | 106507668 | A | 3/2017 |
| CN | 107427709 | A | 12/2017 |
| CN | 206809609 | U | 12/2017 |
| CN | 207342088 | U | 5/2018 |
| DE | 9013998 | U1 | 1/1991 |
| EP | 0265440 | A1 | 5/1988 |
| EP | 1044705 | A1 | 10/2000 |
| JP | 356063465 | U | 5/1981 |
| JP | 359164654 | U | 11/1984 |
| JP | 363146666 | U | 9/1988 |
| SE | 1651023 | A1 | 2/2018 |
| WO | 02087704 | A1 | 11/2002 |
| WO | 2009/098324 | A2 | 8/2009 |
| WO | 2014/058364 | A1 | 4/2014 |
| WO | 2017/174567 | A1 | 10/2017 |

OTHER PUBLICATIONS

International search report for PCT/SE2012/051088.

European search report for EP Application No. 20153446.8, entitled "Trampoline with Corner Support Bar," foreign counterpart of U.S. Appl. No. 16/750,391, filed Jan. 23, 2020, also assigned to Avero AB. Search report dated Jun. 5, 2020.

European search report for EP Application No. 20153445.0, entitled "Silent Performance System and Under Padding Channels in a Trampoline," foreign counterpart of U.S. Appl. No. 16/750,410, filed Jan. 23, 2020, also assigned to Avero AB. Search report dated Jun. 8, 2020.

European search report for EP Application No. 20153447.6, entitled "High-Tension Safety Net in a Trampoline," foreign counterpart of U.S. Appl. No. 16/750,427, filed Jan. 23, 2020, also assigned to Avero AB. Search report dated Jun. 4, 2020.

* cited by examiner

12

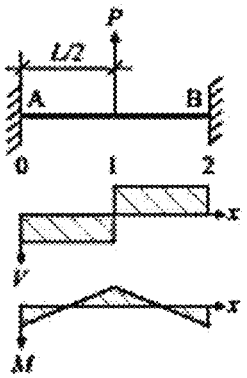

$$R_A = -\frac{P}{2} \qquad R_B = -\frac{P}{2}$$

$$V_{0-1} = \frac{P}{2} \qquad V_{1-2} = -\frac{P}{2}$$

$$M_A = \frac{PL}{8} \qquad M_1 = -\frac{PL}{8} \qquad M_B = \frac{PL}{8}$$

$$v_{0-1} = \frac{PL}{16EI}\left(x^2 - \frac{4x^3}{3L}\right) \qquad v_{max} = \frac{PL^3}{192EI}$$

14

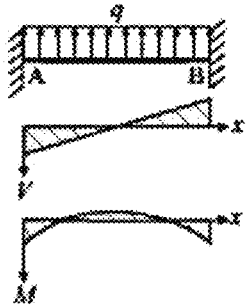

$$R_A = -\frac{qL}{2} \qquad R_B = -\frac{qL}{2}$$

$$V = q\left(\frac{L}{2} - x\right)$$

$$M = \frac{q}{2}\left(\frac{L^2}{6} - Lx + x^2\right)$$

$$M_A = M_B = \frac{qL^2}{12} \qquad M_{mitt} = -\frac{qL^2}{24}$$

$$v = \frac{qL^2}{24EI}\left(x^2 - \frac{2x^3}{L} + \frac{x^4}{L^2}\right) \qquad v_{max} = \frac{qL^4}{384EI}$$

Definitions:

$L$ = length
$E$ = modulus of elasticity
$I$ = moment of expression
$R$ = storage capacity
$V$ = transverse force
$M$ = Bending torque
$\theta$ = angle change
v = deflection

Fig. 3c

CORNER SUPPORT BAR (CSB) IN A TRAMPOLINE

FIELD

Embodiments of the invention relate to a support structure added to strengthen a trampoline's frame. Embodiments of the invention further relate to a trampoline comprising a supplemental support structure added to at least one corner of the trampoline frame.

BACKGROUND

The following description includes information that may be useful in understanding embodiments of the invention. It is not an admission that any of the information provided herein is prior art or relevant to the presently claimed invention, or that any publication specifically or implicitly referenced is prior art.

The modern trampoline era began in the mid-1930s, see, e.g., U.S. Pat. No. 2,370,990 by George Nissen who with Larry Griswold was instrumental in developing the modern trampoline. Even though trampolines were initially developed for competitive or professional purposes, trampolines for recreational use are nowadays popular home entertainment accessories.

A trampoline comprises a flexible mat, a frame, and at least one resilient member. The flexible mat is typically circular, oval, square, rectangular, or stadium (e.g. a rectangle with curved edges). The flexible mat may comprise a cloth or net-shaped structure. It may be made of a polymeric flexible material, such as polypropylene. The frame, conventionally made of metal, encompasses the flexible mat and typically has substantially the same shape as the flexible mat. A circular or oval flexible mat is typically surrounded by a circular or oval frame having a larger diameter than the flexible mat, and a square or rectangular flexible mat is typically surrounded by a substantially square or rectangular frame, which however may comprise rounded-off edges. Likewise, a stadium-shaped trampoline (e.g., a rectangle with curved edges) may have a stadium-shaped mat.

The flexible mat typically comprises a plurality of attachments distributed along the flexible mat's edge. The attachments are adapted to receive one or more resilient members for retaining the flexible mat under tension, creating a suspension system. The resilient members may comprise a plurality of springs (e.g. helical springs) that connect the edge of the flexible mat to the frame, thereby tensioning the flexible mat. When a person is using the flexible mat, i.e. jumping on it, the springs wilt extend in length and thereafter strive to return to their resting length. The spring may be attached to a loop, such as a D-shaped or triangle shaped ring, comprised in the flexible mat by means of a hook that attaches to the spring. Thus, the system of loops and D-rings comprise the plurality of attachments for t e flexible mat to receive the resilient members.

In some trampoline embodiments, the resilient member may comprise an elastic cord. Normally, the elastic cord is long enough to go back and forth between the edge of the flexible mat and the frame several times. Each portion connecting the flexible mat to the frame then forms a segment, which correspond to a spring in the above example. The elastic cord may be so long, that only one elastic cord is utilized for the whole flexible mat, or a plurality of elastic cords may be used.

The flexible mat is conventionally surrounded by an edge pad, which is adapted to at least partly cover the at least one resilient member and/or the frame. The edge pad helps prevent users from stepping or landing between the resilient members, e.g. when climbing onto the flexible mat. The edge pad may also be arranged to cover the frame, thereby reducing a possible impact with the frame in case of stepping or landing on the frame. The edge pad is often made as a number of segments, the shapes of which are adapted to the frame and the flexible mat. For a circular or oval flexible mat, the segments may therefore be arc-shaped. For a square or rectangular flexible mat, rectangular segments may be used. For a stadium-shaped mat, the segments may comprise rectangular segments and curved segments.

While trampolines have improved in recent years, there nevertheless exists a continuous need to improve trampolines to help the sport enter the modern age, especially where such improvements can be accomplished in a commercially reasonable fashion.

SUMMARY OF THE INVENTION

Embodiments of the invention provide a trampoline, comprising a frame, a plurality of leg sections supporting the frame, and a plurality of support bars, wherein a number of support bars of the plurality of support bars equals a number of leg sections of the plurality of leg sections, wherein each support bar is attached to the frame at a location approximately above a corresponding leg section of the plurality of leg sections, wherein the plurality of support bars provides additional stiffness to the frame.

In some embodiments of the invention, a support bar of the plurality of support bars may provide a platform for users entering and leaving the trampoline.

BRIEF DESCRIPTION OF THE DRAWINGS

Embodiments of the invention will be further explained by means of non-limiting examples with reference to the appended drawings. Figures provided herein may or may not be provided to scale. The relative dimensions or proportions may vary. It should be noted that the dimensions of some features of the present invention may have been exaggerated for the sake of clarity.

FIG. 3C depicts the conventional equations for calculating the deflection in a beam.

DETAILED DESCRIPTION OF AN EMBODIMENT OF THE INVENTION

Embodiments of the invention provide, a corner support bar along the trampoline frame's top rail on each of the corners of the frame. The corner support bar stiffens the trampoline's frame, especially in the region bordered by the trampoline support bar and the trampoline's legs which provides better trampoline operation overall and may increase the service life of the trampoline. In this application, frame stiffness refers to the resistance of the frame to movement, especially during trampoline use. Increased frame stiffness generally allows more kinetic energy from the trampoline mat to be imparted to the trampoline user, reduces noise in the trampoline during operation, and increases the frame's useable lifespan.

The corner support bar may also provide an entrance platform for the trampoline by providing a standing pad for trampoline users, according to an, embodiment of the invention. This entrance platform comprises a location above the resilient members (e.g., the helical springs) where trampoline users conventionally stand when they enter a trampoline. This entrance spot presumably comprises just one of the four corner support bars for a rectangular, square trampoline, or stadium-shaped trampoline, for example, although some embodiments of the invention might allow for additional entrance and exit points. The corner support bar may also provide support for other uses, according to various embodiments of the invention.

For square, rectangular and stadium-shaped trampolines, the corner support bar can be formed where two edges of the trampoline frame intersect (either actually intersect or approximately intersect in the case of a stadium-shaped trampoline), particularly in the region immediately above the trampoline's legs. For circular trampolines, the corner support bars can be added, at any location, although it is preferable for the corner support bars to be placed above the trampoline's legs, and it may be further preferable to locate the corner support bars equidistant from each other, according to an embodiment of the invention.

The corner support bar should preferably not intrude (or only minimally intrude) on the surface area of the trampoline jumping flexible mat, and the corner support bar may be covered by the trampoline edge pad, according to an embodiment of the invention.

Figure 1:
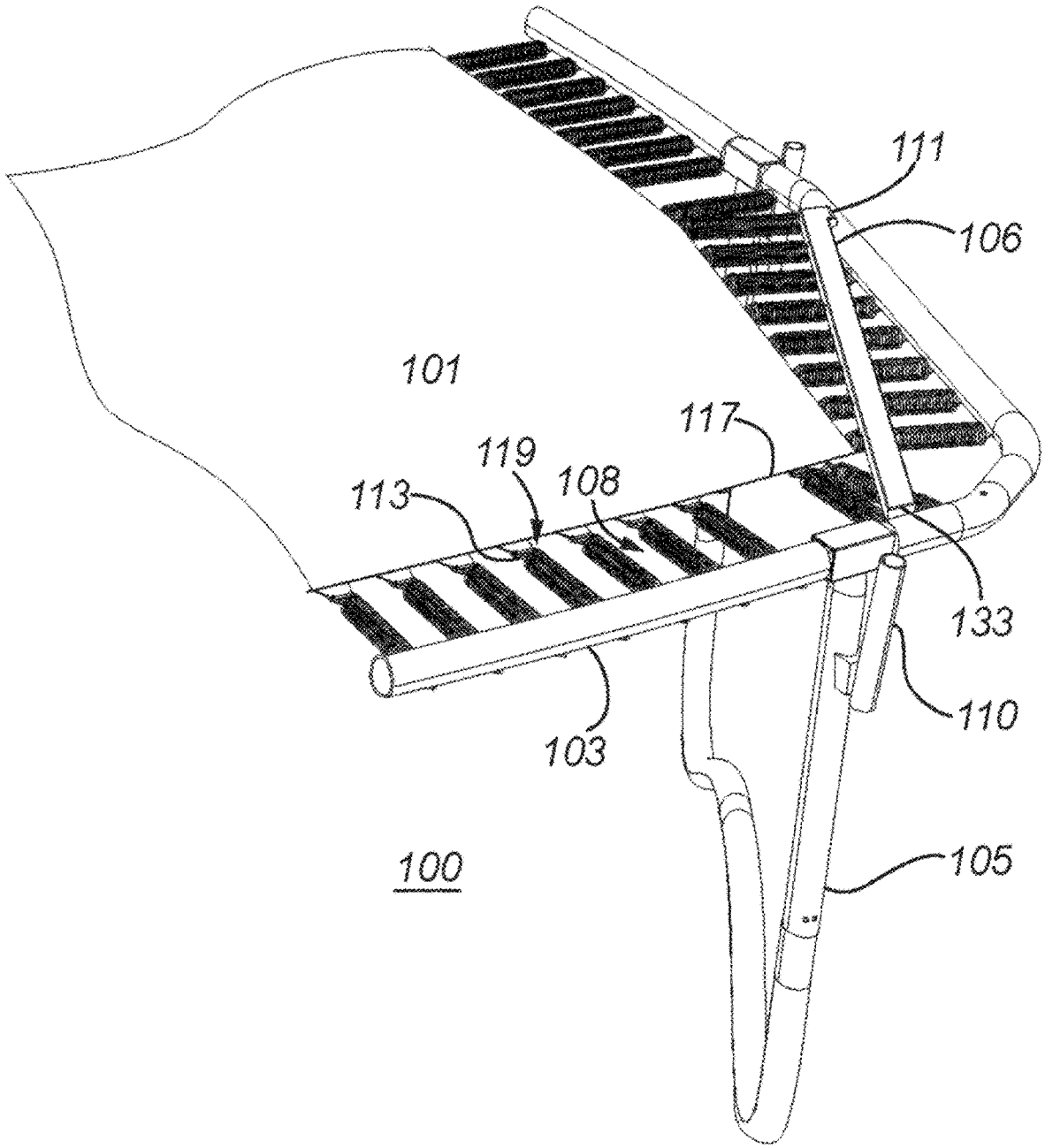
FIG. 1 illustrates a trampoline 100 having a support bar 106 that provides increased stiffness to the frame 103 of the trampoline 100, according to an embodiment of the invention.

FIG. 1 illustrates a trampoline 100 having a support bar 106 that provides increased stiffness to the frame 103 of the trampoline 100, according to an embodiment of the invention. The support bar 106 has been placed on the topline of the frame 103, as shown in FIG. 1, according to an embodiment of the invention.

The trampoline 100 includes a flexible mat 101 held to the frame 103 by a plurality of resilient members 108. The fabric of the flexible mat 101 that users jump or bounce on is often not elastic itself, instead the resilient members 108 (e.g., helical springs) provide the elasticity which creates the potential energy that trampoline users enjoy as kinetic energy. Thus, the resilient members 108 provide a suspension system for the trampoline 100 that receives and reflects energy to the trampoline users. The resilient members 108 may comprise helical springs, according to an embodiment of the invention. The resilient members 108 are typically not attached directly to the flexible mat 101 but are instead attached to D-rings 113 that themselves are attached to the flexible mat 101. The resilient members 108 may attach to an underside of the frame 103, according to an embodiment of the invention. This approach lowers the stress placed on the flexible mat 101 by the plurality of resilient members 108. This arrangement of the suspension system is known in the prior art, such as shown in PCT/EP2017/057961, "Safety Net for a Trampoline, A Trampoline, and a Method of Arranging a Safety Net in a Trampoline," which is hereby incorporated by reference.

The resilient members 108 are attached at or adjacent to an edge 117 of the flexible mat 101 by attachments 119 that include D-shaped or triangle-shaped rings 113. The attachment 119 permits the at least one resilient member 108 to connect to the flexible mat 101. The resilient members 108 may attach to various points on the frame 103. As shown in FIG. 1, the resilient members 108 attach on the underside of the frame 103, according to an embodiment of the invention.

The frame 103 has a resident level of stiffness that aids the plurality of resilient members 108 in providing a suspension for the trampoline 100. If the frame 103 can be made more rigid, then more of the energy input to the trampoline 100 will be reflected back to the users.

Attaching a plurality of support bars 106 to the frame 103 increases the stiffness of the frame 103, according to an embodiment of the invention. The support bars 106 may be placed, for example in each of the corners of a rectangular and/or square trampoline and/or at consistent locations on a round trampoline. The support bars 106 may be attached to the frame by a number of mechanisms from welding the support bars 106 to the frame 103 to bolting or screwing the support bars 106 to the frame 103.

The support bars 106 may be placed from one top rail side 111 of the frame 103 and extend to another side 133. The precise location of the support bar 106 may vary in various embodiments of the trampoline 100. However, the support bar 106 is likely to better achieve its goal of stiffening the frame 103 when the support bar is located above or in the vicinity of the trampoline's legs 105. This way the support bar 106 and the legs 105 beneath it effectively form a unified support structure, according to an embodiment of the invention. Among other things, the support bar 106 prevents the legs 105 from moving inwards towards the mat 101 because the support bar 106 tightens the frame 103, hindering movement in this direction, according to an embodiment of the invention. The legs 105 comprise a uniform leg section, joined at the bottom surface, that further connects to the frame 103 at a first location near a corner of the frame 103 and at a second location near another corner of the frame 105. Of course, in some embodiments the legs 105 may comprise separate leg sections not connected together.

In addition, the support bar 106 should not be located so close to the flexible mat 101 that the user may land on the support bar 106 during normal trampoline use. Thus, the support bar may run along a tangent to the corner of the flexible mat 101, as shown in FIG. 1. As will be shown in FIG. 5A, the support bar 106, like the frame 103, will typically be covered by an edge pad, such as the edge pad 504 shown in FIG. 5A. Thus, if the support bar 106 intrudes into the flexible mat 101 then the support bar 106 should be covered by the edge pad, reducing the available jumping area of the flexible mat 101.

The support bar 106 may also be used to provide support underneath the trampoline user when the trampoline user enters the trampoline 100. Because of vertical support leg 105, the trampoline 100 typically rests at a slightly higher elevation than the floor on which the trampoline 100 stands. Thus, the user typically needs to step up and into the trampoline 100 in order to use it. Consequently, users may find it helpful to have a semi-solid area on which to stand when entering and exiting the trampoline 100, and a semi-solid area on which to stand that is something other than the resilient members 108 covered by an edge pad.

FIG. 1 also shows, a holder 110 for a vertical support pole. The vertical support poles will hold a safety net that prevents the user from falling off the trampoline 100.

Figure 2:
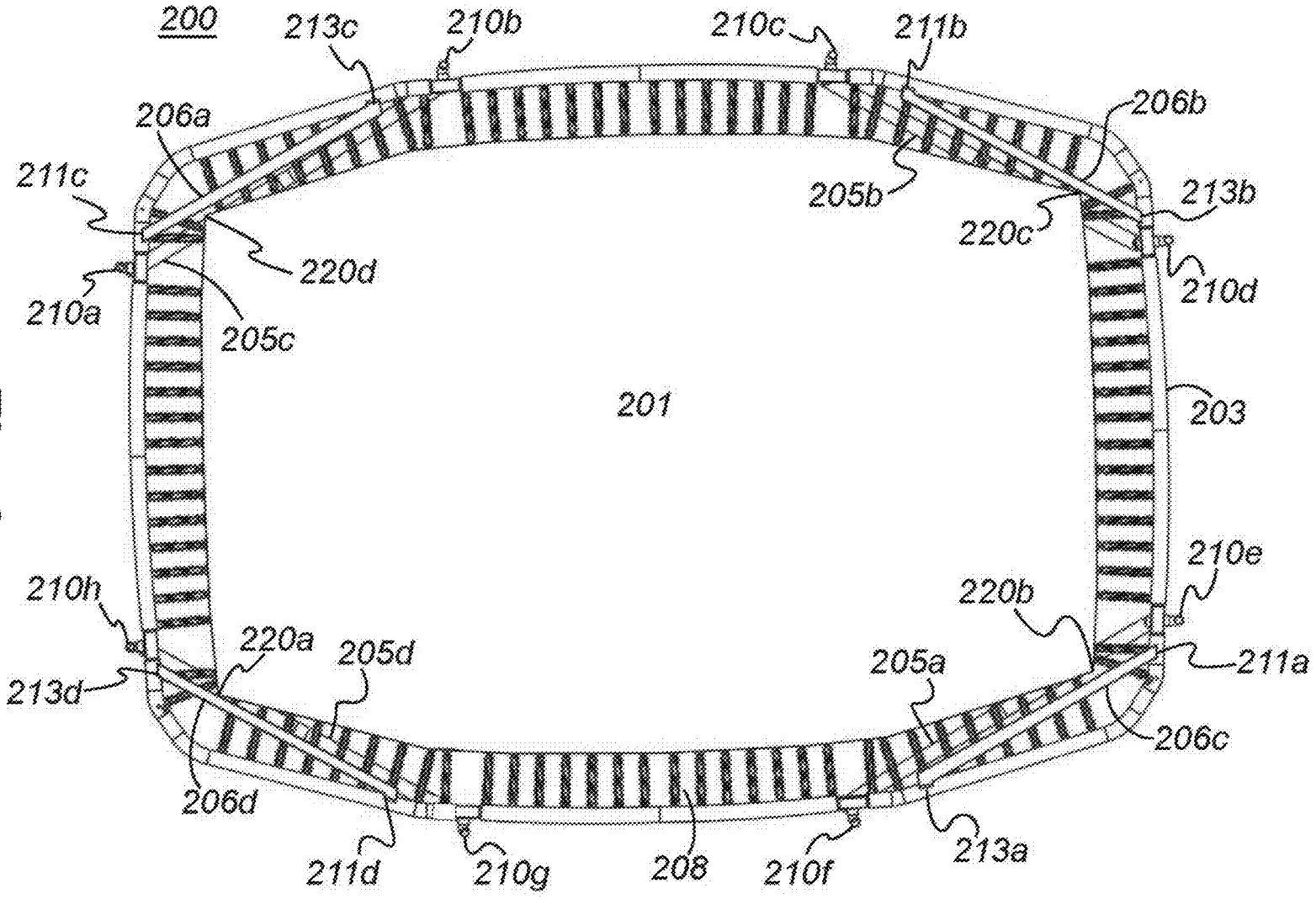
FIG. 2 illustrates an overhead view of a trampoline 200 having support bars 206*a*, 206*b*, 206*c*, and 206*d*, according to an embodiment of the invention.

FIG. 2 illustrates an overhead view of a trampoline 200 having support bars 206*a*, 206*b*, 206*c*, and 206*d*, according to an embodiment of the invention.

The trampoline 200 includes a flexible mat 201 held to a frame 203 by a plurality of resilient members 208. The fabric of the flexible mat 201 that users jump or bounce on is often not elastic itself, instead the resilient members 208 (e.g., helical springs) provide the elasticity which creates the potential energy. The resilient members 208 provide a suspension system for the trampoline 200 that receives and reflects energy to the trampoline users. The resilient members 208 may comprise helical springs, according to an embodiment of the invention. As discussed in FIG. 1, the resilient members 208 are typically not attached directly to the flexible mat 201 but are instead attached to D-rings that themselves are attached to the flexible mat 201. This approach lowers the stress placed on the flexible mat 201 by the plurality of resilient members 208.

The frame 203 has a resident level of stiffness that aids the plurality of resilient members 208 in providing a suspension for the trampoline 200. If the frame 203 can be made more rigid, then more of the energy input to the trampoline 200 will be reflected back to the users.

Attaching a plurality of support bars 206*a*, 206*b*, 206*c*, and 206*d* to the frame 203 increases the stiffness of the frame 203, according to an embodiment of the invention. The support bars 206*a*, 206*b*, 206*c*, and 206*d* may be placed, for example in each of the corners of a rectangular trampoline 200. The support bars 206*a*, 206*b*, 206*c*, and 206*d* may be attached to the frame 203 by a number of mechanisms from welding the support bars 206*a*, 206*b*, 206*c*, and 206*d* to the frame 203 to bolting or screwing the support bars 206*a*, 206*b*, 206*c*, and 206*d* to the frame 203.

The support bars 206*a*, 206*b*, 206*c*, and 206*d* may be placed from one side 211*a*, 211*b*, 211*c*, 211*d* of the frame 203 and extend to another side 213*a*, 213*a*, 213*b*, 213*c*, 213*d*.

The precise location of the support bars 206*a*, 206*b*, 206*c*, and 206*d* may vary in various embodiments of the trampoline 200. The support bars 206*a*-206*d* may be located directly above a respective leg 205*a*-205*d*, according to an embodiment of the invention. Placing the support bar 206*a* approximately above the leg 205*c* stiffness the portion of the frame 203 in the corner area, e.g., the portion of the frame from 211*c* to 213*c*. Thus, the portions of the frame 203 that will receive less benefit from the support bars 206*a*-206*d* are the areas of the frame 203 outside the support bars 206*a*-206*d*, e.g., the area of the frame 203 from 210*b* to 210*c*.

The support bar 206*a*, 206*b*, 206*c*, and 206*d* should generally avoid intruding into the effective jumping area of the flexible mat 201. As a general rule, the support bar 206 should not be located so close to the flexible mat 201 that the user may land on the support bar 206*a*, 206*b*, 206*c*, and 206*d* during normal trampoline use. FIG. 2 shows the support bar 206*a*, 206*b*, 206*c*, and 206*d* running along lines tangent to corner points 220*a*, 220*b*, 220*c*, 220*d* of the flexible mat 201, which avoids the flexible mat 201. As will be shown in FIG. 5A, the support bar 206 like the frame 203 will typically be covered by an edge pad, such as the edge pad 504 shown in FIG. 5A.

The support bars 206*a*, 206*b*, 206*c*, and 206*d* may also be used to provide support underneath the user when the user enters the trampoline 200. Because of vertical support legs 205*a*, 205*b*, 205*c*, 205*d*, the trampoline 200 typically rests at a slightly higher elevation than the floor on which the trampoline 200 stands. Thus, the trampoline user needs to step up and into the trampoline 200 in order to use it. Consequently, trampoline users may find it helpful to have a semi-solid area on which to stand when entering and exiting the trampoline 200. In conventional trampolines, the users often enter the trampoline by stepping on the resilient members 208 covered by an edge pad, which causes extra wear on the resilient members 208 and can pose a safety hazard.

FIG. 2 also shows holders 210*a*-210*h* for a vertical support pole. The vertical support poles may hold a safety net that prevents the user from falling off the trampoline 200.

Figure 3A:
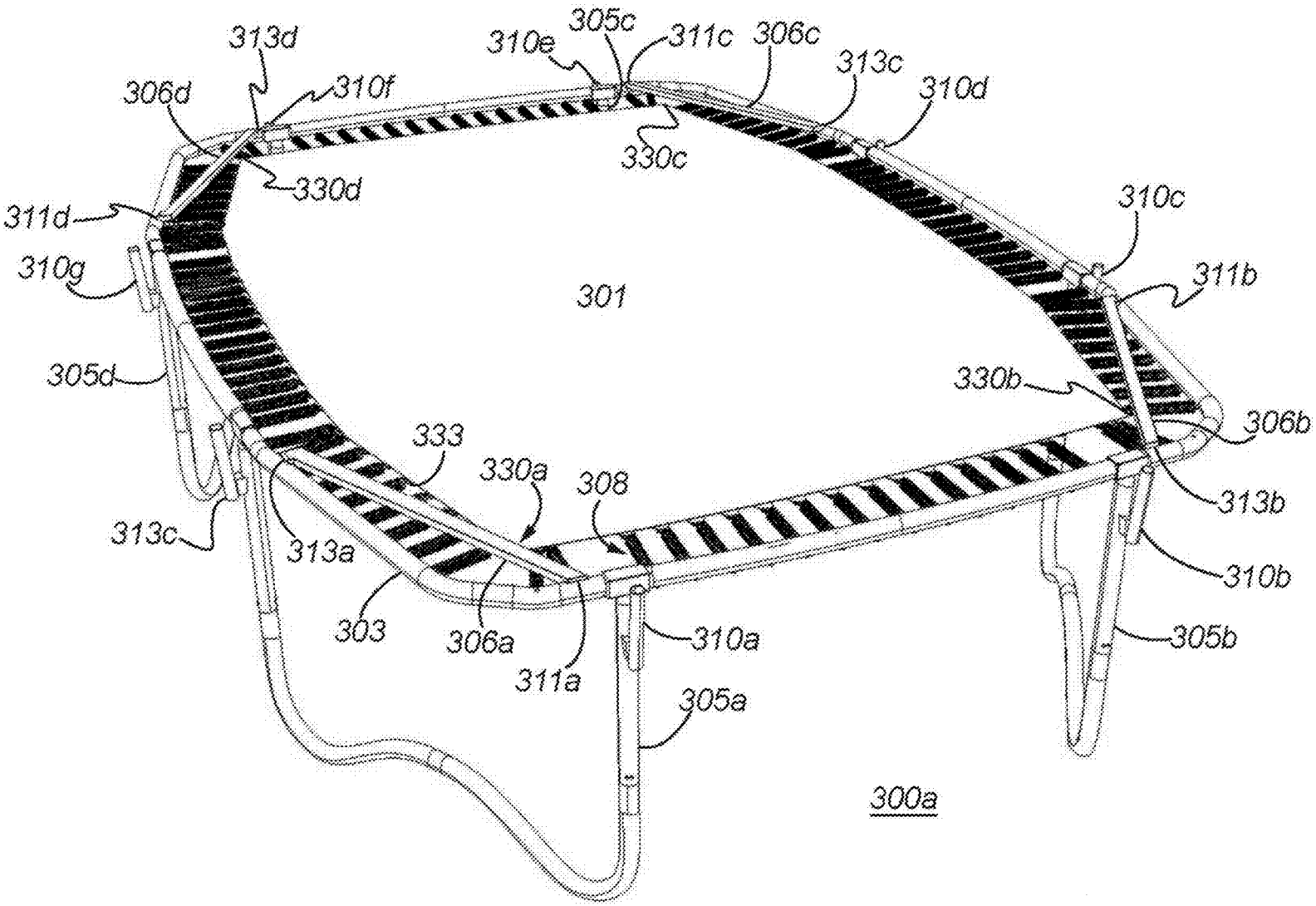
FIG. 3A illustrates an overhead view of a trampoline 300*a* having support bars 306*a*, 306*b*, 306*c*, and 306*d*, according to an embodiment of the invention.

FIG. 3A illustrates an overhead view of a trampoline 300*a* having support bars 306*a*, 306*b*, 306*c*, and 306*d*, according to an embodiment of the invention.

The trampoline 300*a* includes a flexible mat 301 held to a frame 303 by a plurality of resilient members 308. The fabric of the flexible mat 301 that users jump or bounce on is often not elastic itself, instead the resilient members 308 (e.g., helical springs) provide the elasticity which creates the potential energy that the users enjoy as kinetic energy. The resilient members 308 provide a suspension system for the trampoline 300*a* that receives and reflects energy to the trampoline users. The resilient members 308 may comprise helical springs, according to an embodiment of the invention. As discussed in connection with FIG. 1, the resilient members 308 are typically not attached directly to the flexible mat 301 but are instead attached to D-rings 333 that themselves are attached to the flexible mat 301. This approach lowers the stress placed on the flexible mat 301 by the plurality of resilient members 308.

The frame 303 has a resident level of stiffness that aids the plurality of resilient members 308 in providing a suspension for the trampoline 300*a*. If the frame 308 can be made more rigid, then more of the energy input to the trampoline 300*a* will be reflected back to the users.

Attaching a plurality of support bars 306*a*, 306*b*, 306*c*, and 306*d* to the frame 303 increases the stiffness of the frame 303, according to an embodiment of the invention.

The support bars 306*a*, 306*b*, 306*c*, and 306*d* may be placed, for example in each of the corners of a rectangular trampoline 300*a*, according to an embodiment of the invention. The support bars 306*a*, 306*b*, 306*c*, and 306*d* may be attached to the frame 303 by a number of mechanisms from welding the support bars 306*a*, 306*b*, 306*c*, and 306*d* to the frame 303 to bolting or screwing the support bars 306*a*, 306*b*, 306*c*, and 306*d* to the frame 303.

The support bars 306*a*, 306*b*, 306*c*, and 306*d* may respectively be placed from one side 311*a*, 311*b*, 311*c*, 311*d* of the frame 303 and extend to another side 313*a*, 313*a*, 313*b*, 313*c*, 313*d*. The precise location of the support bars 306*a*, 306*b*, 306*c*, and 306*d* may vary in various embodiments of the trampoline 300*a*. As illustrated more clearly in FIG. 3B, placing support bars over the trampoline's legs creates an area in the trampoline frame 303 of particularly increased stiffness, e.g., placing the support bar 306*a* over legs 305*a*.

Another consideration in the location of the support bars 306*a*-306*d* is the amount that the support bar 306*a*-306*d* that should extend into the effective area of the flexible mat 301. As a general rule, the support bar 306 should not be located so close to the flexible mat 301 that the user may land on the support bar 306*a*, 306*b*, 306*c*, and 306*d* during normal jumping.

FIG. 3A shows the support bar 306*a*, 306*b*, 306*c*, and 306*d* respectively running along lines tangent to corner points 330*a*, 330*b*, 330*c*, 330*d* of the flexible mat 301. As will be shown in FIG. 5A, the support bar 306 like the frame 303 will typically be covered by an edge pad, such as the edge pad 504 shown in FIG. 5A.

The support bars 306*a*, 306*b*, 306*c*, and 306*d* may also provide support underneath the user when the user enters the trampoline 300*a*. Because of vertical support legs 305*a*, 305*b*, 305*c*, 305*d*, the trampoline 300*a* typically rests at a slightly higher elevation that the floor on which the trampoline 300*a* stands. Thus, the trampoline user needs to step up and into the trampoline 300*a* in order to use it. Consequently, trampoline users may find it helpful to have a semi-solid area on which to stand when entering and exiting the trampoline 300*a*.

FIG. 3A also shows holders 310*a*-310*h* for a vertical support pole. The vertical support poles may hold a safety net that prevents the user from falling off the trampoline 300*a*.

Figure 3B:
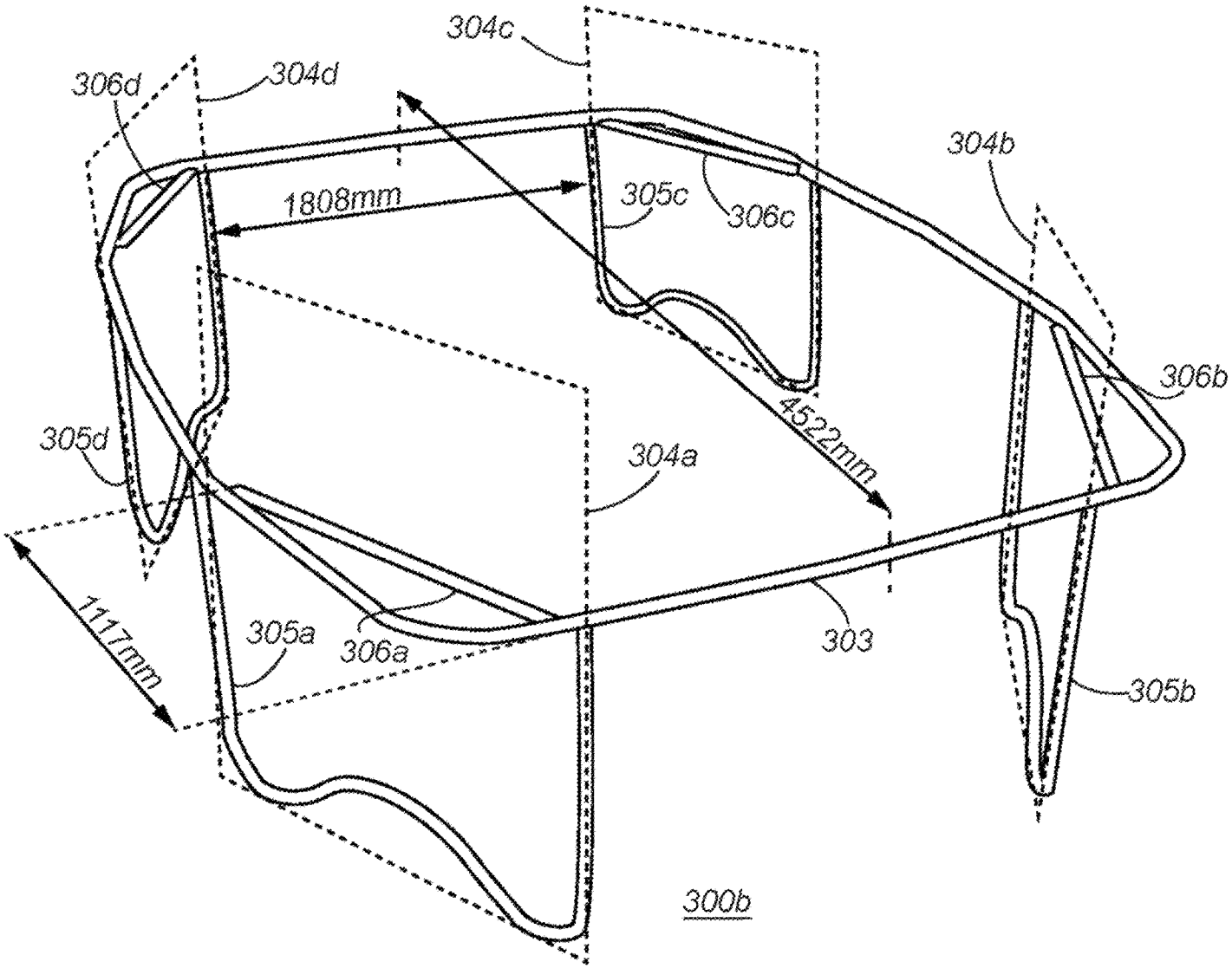
FIG. 3B provides an abstract view of a trampoline 300*b* illustrating how the support bars 306*a*-306*d* strengthen the area of the trampoline 300*b* bordered by the legs 305*a*-305*d*, according to an embodiment of the invention.

FIG. 3B provides an abstract view of a trampoline 300*b* illustrating how the support bars 306*a*-306*d* strengthen the area of the trampoline 300*b* bordered by the legs 305*a*-305*d*, according to an embodiment of the invention.

The boxes 304*a*-304*d* respectively show regions of frame stiffening on the frame 303 brought about, by the combination of a support bar and the frame's legs, e.g., the support bar 306*a* in combination with the legs 305*a*. Thus, the region of the frame 303 that receives less stiffening from the support bars 306*a*-306*d* is the region of the frame 303 located between the support bars 306*a*-306*d*. Referring to FIG. 3A, this would be the regions of the frame between points 313*c*-311*b*, 311*a*-313*b*, 311*d*-313*a*, 313*d*-311*c* with regions of heightened stiffening running between points 311*a*-313*a*, 311*b*-313*b*, 311*c*-313*c*, and 311*d*-313*d*, according to an embodiment of the invention.

Applying the dimensions of an actual trampoline to the trampoline 300*b* yields the following. The trampoline 300*b* has an approximately rectangular shape. Assume that the trampoline 300*b* ranges from approximately 10 feet (roughly 3048 mm) on its narrower side to approximately 15 feet (roughly 4522 mm) on its longer side. The boxes 304*a*-304*d* at the level of the frame 303 on the longer side of the frame 303 each have a dimension of approximately 1117 mm on the long side of the frame. If shown, the boxes 304*a*-304*d* would cover 620 mm on the short side of the frame 303. Thus, the long side of the frame 303 comprises approximately 2234 mm of combined support bar strength, e.g., the support bars 306*a*, 306*d* on one of the long sides of the trampoline 303*b* or 306*b*, 306*c* on the other long side of trampoline 303*b*. The short side of the frame 303 comprises approximately 1240 mm of combined support bar strength, e.g., the support bars 306*d*, 306*c* on one of the short sides of the trampoline 303*b* or 306*a*, 306*b* on the other short side of the trampoline. Thus, for a trampoline that is 3048 mm by 4522 mm with two support bars covering 1117 mm (or 2234 mm together) on each long side, then the long side has only 2288 mm not directly supported by the support bars, and with two support bars covering 620 mm (or 1240 mm together) on each short side, then the short side has 1808 mm not directly supported by the support bars, according to an embodiment of the invention.

The additional stiffness provided by the support bars, such as the support bar 306*a*, to the frame 303 can be calculated using an appropriate set of beam bending calculations. FIG. 3C provides the conventional equations for calculating the deflection in a beam. These equations should be well known to an ordinary artisan in the relevant field and will not be otherwise explained here.

FIGS. 3D-3G provide calculations related to the stiffness provided in a trampoline frame having the dimensions of approximately 10 feet by 15 feet (roughly 3048 mm×4522 mm) described in FIG. 3B under three different scenarios related to support bars, according to an embodiment of the invention.

The stiffness or deflection calculations applicable to these three scenarios are as follows. The ordinarily skilled artisan should note that the following calculations include some simplifications. To make a more accurate calculation than the calculations provided here, an ordinarily skilled artisan would need, to perform a complete Finite Element Method (FEM) analysis. Gaps in joints, such as the joints of a trampoline frame (e.g., the trampoline frame 300*a* shown in FIG. 3*a*) may have a large impact on overall frame stiffness but have not been included in the calculations provided here.

Figure 3D:
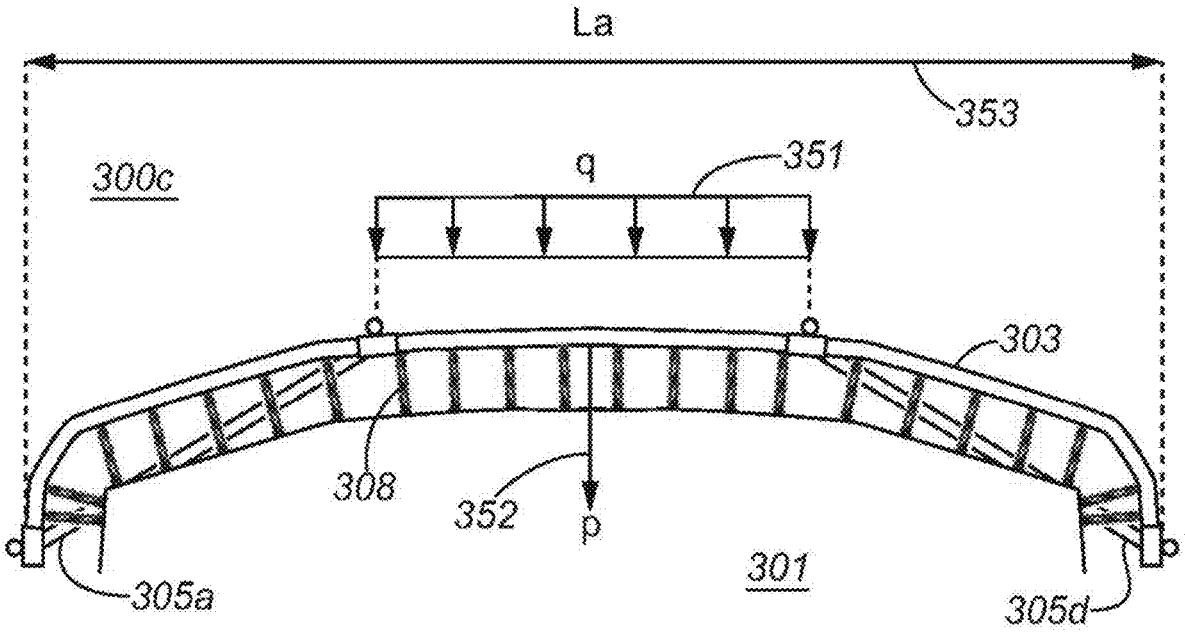
FIG. 3D illustrates a first scenario of a frame having no reinforcement bar.
Figure 3E:
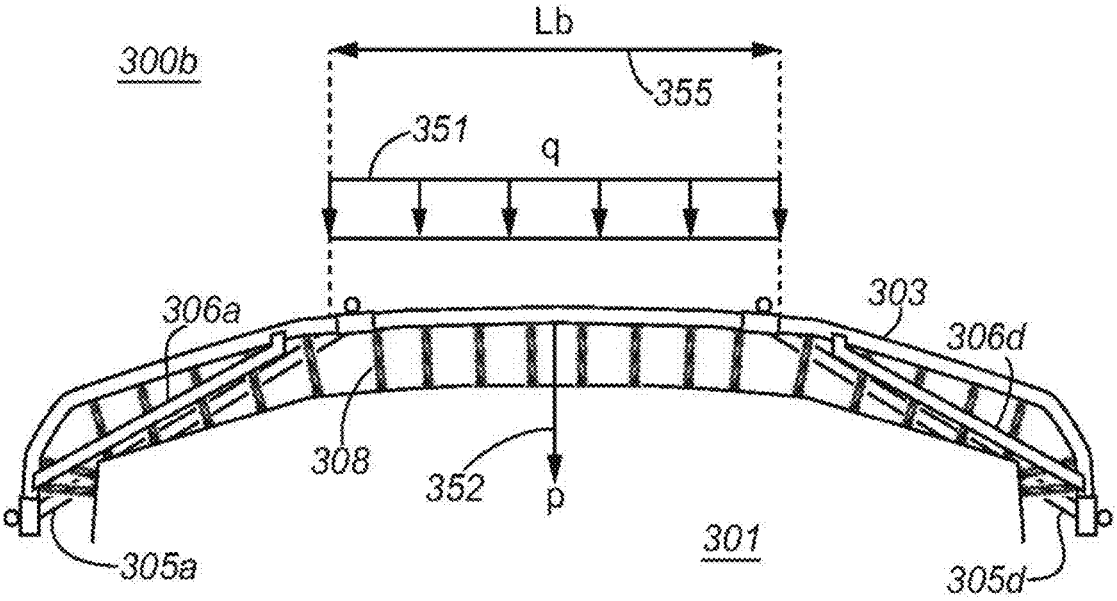
FIG. 3E illustrates a second scenario of a frame having support bars 306*a*, 306*d* similar to the support bar 106 shown in FIG. 1.
Figure 3F:
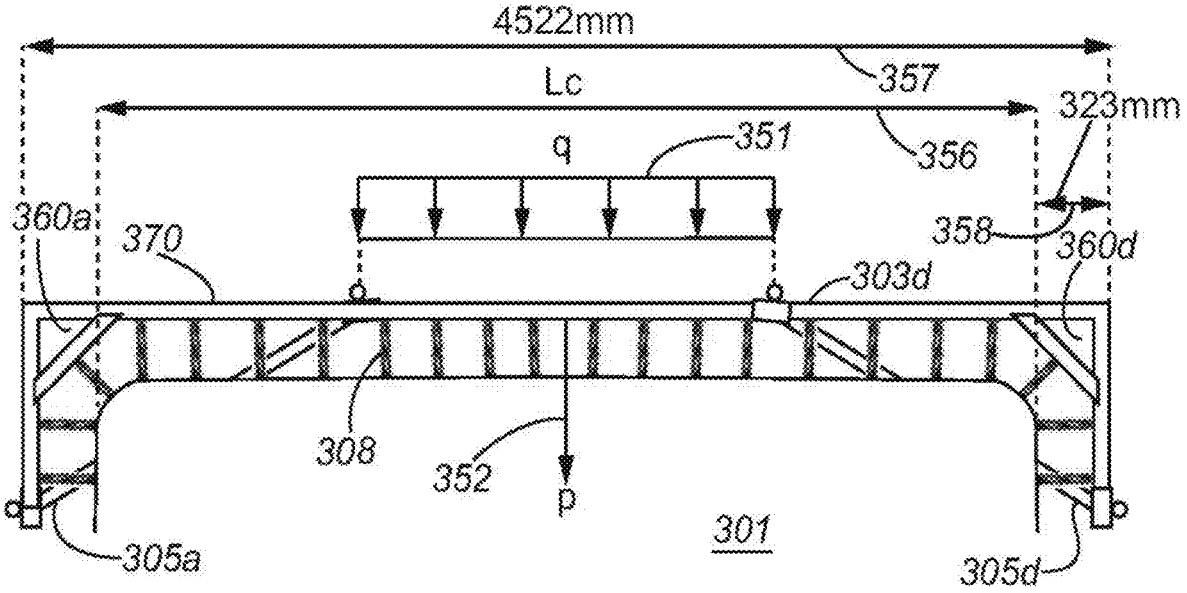
FIG. 3F illustrates a third scenario in which a section of a trampoline also has mini-support bars 360*a*, 360*d* provided across a small portion of a trampoline's frame.

Three different load scenarios have been provided herein. FIG. 3D provides the first scenario of a frame having no reinforcement bar. FIG. 3E provides the second scenario of a frame having support bars 306*a*, 306*d* similar to the support bar 106 shown in FIG. 1. FIG. 3F illustrates a third scenario in which a section of a trampoline also has mini-support bars 360*a*, 360*d* provided across a small portion of a trampoline's frame. The mini-support bars 360*a*, 360*d* provide support for the trampoline frame at the point where the springs essentially begin. The mini-support bars 360*a*, 360*d* cannot be made larger without interfering with placement of the springs attached to the top rail of the trampoline frame shown in FIG. 3F.

The trampolines in these three scenarios include a mat 301, resilient members 308, and a frame 303 (FIG. 3D, FIG. 3E) or a frame 370 (FIG. 3F), and legs 305*a*, 305*d*.

For each of the three scenarios described, the calculations have been made for two cases, a point load P 352 at the center of the frame 303 and a widened load q 351 between the intended support bar attachment locations. A comparison is provided between these two cases for these scenarios. The actual performance of a real trampoline frame is likely somewhere between these values.

In addition to the equations shown in FIG. 3C, additionally relevant values for these scenarios are: $q=P/L_b$, E 210

$GP_a$, $I_{pipe}=\pi*(D^4-d^4)/64$, where D=60 mm and d=55 mm. P is set at 150 kg where $L_b$ is the length between the two support bars on the trampoline's long side (e.g., the length between the end of support bar 306*a* and the end of support bar 306*d* on the same side of trampoline 300*c* shown in FIG. 3E), $I_{pipe}$ is the moment of expression of the frame pipe (the hollow trampoline frame), D is the outer diameter of the frame pipe, and d is the inner diameter of the frame pipe.

FIG. 3D illustrates the load or stiffness case in a trampoline 300*c* that has no support bar, such as the support bar 106 illustrated in FIG. 1. In other words, the trampoline 300*c* represents a conventional trampoline.

Applying the trampoline dimensions shown in FIG. 3B to the scenario shown in FIG. 3D and using the equations shown in FIG. 3C as well as those described above, leads to these calculations for the trampoline 300*c:*

$L_a$=4522 mm, where $L_a$ is the length of a side of the trampoline frame $L_b$=4522−(1117+1117)=2288 mm Stiffness 12→$V_{max\text{-}A12}=P*(L_a)^3/(192*EI)$ Stiffness 14→$V_{max\text{-}A14}=q*(L_a)^4/(384*EI)=P*(L_a)^4/(L_b*384*EI)$ FIG. 3E illustrates the load or stiffness case in a trampoline 300*b* (also shown in FIG. 3B) that has support bars 306*a*, 306*d* dimensioned similarly to the support bar 106 illustrated in FIG. 1. If FIG. 3E showed the trampoline 300*b* in complete detail, it would also include support bars 306*b*, 306*c*, as shown in FIG. 3A. In other words, the trampoline 300*b* represents an embodiment of the invention.

Applying the trampoline dimensions shown in FIG. 3B to the scenario shown in FIG. 3E and using the equations shown in FIG. 3C as well as those described above, leads to these calculations for the trampoline 300*b:*

$L_b$=4522−(1117+1117)=2288 mm

Stiffness 12→$v_{max\text{-}B12}=P*(L_b)^3/(192*EI)$

Stiffness 14→$v_{max\text{-}B14}=q*(L_b)^4/(384*EI)=P*(L_b)^4/(L_b*384*EI)$

FIG. 3F illustrates a trampoline 300*d* having mini-support bars 360*a*, 360*d* provided across a corner of t e trampoline's frame 370. The mini-support bars 360*a*, 360*d* provide support for the frame 370 at point where the springs 308 begin. The mini-support bars 360*a*, 360*d* include at least one spring 308. The mini-support bars 360*a*, 360*d* cannot extend across a larger corner of the frame 370 without interfering with placement of the springs 308, which are attached to the upper portion of the trampoline frame 370. As previously discussed with respect to the trampoline 300*a* shown in FIG. 3A, the springs 308 for this trampoline attach along a lower or bottom portion of the frame 303. In the trampoline 300*d* shown in FIG. 3F, the mini-support bars 360*a*, 360*d* cross from one side of the frame 370 to the other side of the frame 370 at an approximately 45° angle.

Figure 3G:
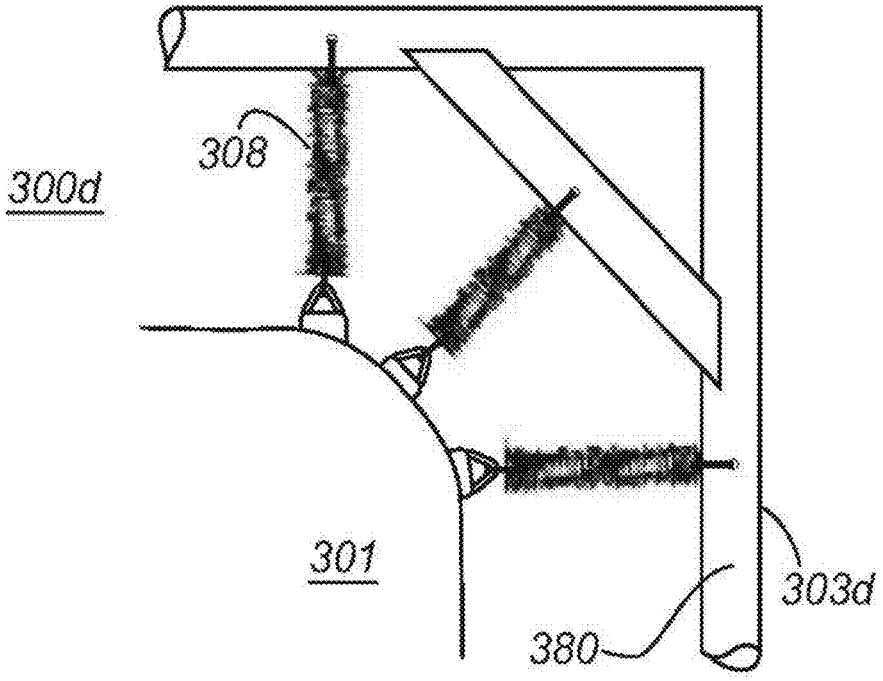
FIG. 3G provides a close up of the mini-support bar 360*d* shown in FIG. 3F.

FIG. 3G provides a close up of the mini-support bar 360*d* shown in FIG. 3F. The trampoline 300*d* comprises a mini-support bar 360*d* having one resilient member 308 and placed at an approximately 45° angle between two other resilient members. As shown in FIG. 3G, these resilient members 308 are connected to a top side 380 of the frame 303*d*.

Applying the trampoline dimensions shown in FIG. 3B to the scenario shown in FIG. 3F and using the equations shown in FIG. 3C as well as those described above, leads to these calculations for the trampoline 300*d:*

$L_c$=4522−(323+323)=3876 mm, where $L_c$ relates to the length of the mini-support bars 360*a*, 360*d*

Stiffness 12→$v_{max\text{-}c12}=P*(L_c)^3/(192*EI)$

Stiffness 14→$v_{max\text{-}c14}=q*(L_c)^4/(384*EI)=P*(L_c)^4/(L_b*384*EI)$

Comparing the scenarios shown in FIGS. 3B-3F leads to the following comparative calculations.

Trampoline 300*c* from FIG. 3D compared with Trampoline 300*b* from FIG. 3E:

$V_{max\text{-}A12}/V_{max\text{-}B12}=(P*(L_a)^3/(192*EI))/(P*(L_b)^3/(192*EI)=(L_a)^3/(L_b)^3=(4522)^3/(2288)^3=7.72$ times $V_{max\text{-}A14}/V_{max\text{-}B14}=(P*(L_a)^4/(L_b*384*EI))/(P*(L_b)^4/(L_b*384*EI))=(L_a)^4/(L_b)^4=(4522)^4/(2288)^4=15.26$ times Trampoline 300*c* from FIG. 3D compared with Trampoline 300*d* from FIG. 3F:

$V_{max\text{-}A12}/V_{max\text{-}C12}=(P*(L_a)^3/(192*EI))/(P*(L_c)^3/(192*EI))=(L_a)^3/(L_c)^3=(4522)^3/(3876)^3=1.59$ times $V_{max\text{-}A14}/V_{max\text{-}C14}=(P*(L_a)^4/(L_b*384*EI))/(P*(L_c)^4/(L_b*384*EI))=(L_a)^4/(L_c)^4=(4522)^4/(3876)^4=1.85$ times Trampoline 300*b* from FIG. 3E compared with Trampoline 300*d* from FIG. 3F:

$V_{max\text{-}B12}/V_{max\text{-}C12}=7.72/1.59=4.86$ times $V_{max\text{-}B14}/V_{max\text{-}C14}=15.26/1.85=8.24$ times Thus, the support bar 306*a*, 306*d* shown in FIG. 3E contributes to a reduced bending rate of between 8-15 times compared to not having a support bar at all as shown in FIG. 3D. Comparing the support bars 306*a*, 306*d* with the mini-support bars 360*a*, 360*d* shown in FIG. 3F, yields a deflection decrease between 5-8 times for the support bars 306*a*, 306*d*.

In absolute terms, the scenarios shown in FIG. 3D-3F yield the following equations. To see the kind of bends these three scenarios provided in millimeters (mm), yields the following values when inserted into the equations previously provided.

$L_a$=4522 mm $L_b$=2288 mm $L_c$=3876 mm $q=P/L_b$ $E$=210 $GP_a$=210,000 $N/mm^2$ $I_{pipe}=\pi*(D^4-d^4)/64$, where $D$=60 mm and $d$=55 mm.

P is set to 150 kg, also 1500 N.

The stiffness scenario shown in FIG. 3D for the trampoline frame 300*c* yields the following:

Stiffness 12→$v_{max\text{-}A12}=P*(L_a)^3/(192*EI)=1500*(4522)^3/(192*210000*\pi*(((60)^4-(55)^4)/64))=18.4$ mm $$\text{Stiffness 14} \rightarrow v_{max\text{-}A14}=q*(L_a)^4/(384*EI)=P*(L_a)^4/(L_b*384*EI)=1500*(4522)^4/(2288*384*210000*(((60)^4-(55)^4)/64))=18.2\text{ mm}$$

The stiffness scenario shown in FIG. 3E for the trampoline frame 300*b* yields the following:

$$\text{Stiffness 12} \rightarrow v_{max\text{-}B12}=P*(L_b)^3/(192*EI)=1500*(2288)^3/(192*210000*\pi*(((60)^4-(55)^4)/64))=2.4\text{ mm}$$

$$\text{Stiffness 14} \rightarrow v_{max\text{-}B14}=q*(L_b)^4/(384*EI)=P*(L_b)^4/(L_b*384*EI)=1500*(2288)^4/(2288*384*210000*(((60)^4-(55)^4)/64))=1.2\text{ mm}$$

The stiffness scenario shown in FIG. 3F for the trampoline frame 300*d* yields the following:

$$\text{Stiffness 12} \rightarrow v_{max\text{-}C12}=P*(L_c)^3/(192*EI)=1500*(3876)^3/(192*210000*\pi*(((60)^4-(55)^4)/64))=11.6\text{ mm}$$

$$\text{Stiffness 14} \rightarrow v_{max\text{-}C14}=q*(L_c)^4/(384*EI)=P*(L_c)^4/(L_b*384*EI)=1500*(3876)^4/(2288*384*210000*(((60)^4-(55)^4)/64))=9.8\text{ mm}$$

In summary, the deflection shown in the FIGS. 30-3F illustrate that the support bars 306*a*, 306*d* provide a substantially stiffer frame than the alternatives discussed. These calculated numbers only consider the long beam of the trampoline bending inward and do not take into account that the trampoline can also bends downwards. Of course, the support bars (e.g., the support bar 306*a*) also bend although together the frame and the support bar become quite stiff. The remaining movements such as slipping in joints are not included and these can probably be considered significant relative to the bending of the frame.

In the first stiffness scenario for the trampoline 300*c* having no reinforcing support bar, the trampoline has an inward deflection is about 18 mm.

In the third stiffness scenario for the trampoline 300*d* having the mini-support bars 360*a*, 360*d*, the inward deflection is about 11 mm.

In the second stiffness scenario that shows a support bar 306*a*, 306*d* similar to the support bar 106 shown in FIG. 1, the inward deflection is about 2 mm.

The difference is thus considerable in terms of the deflection of the long top rail beam.

Figure 3H:
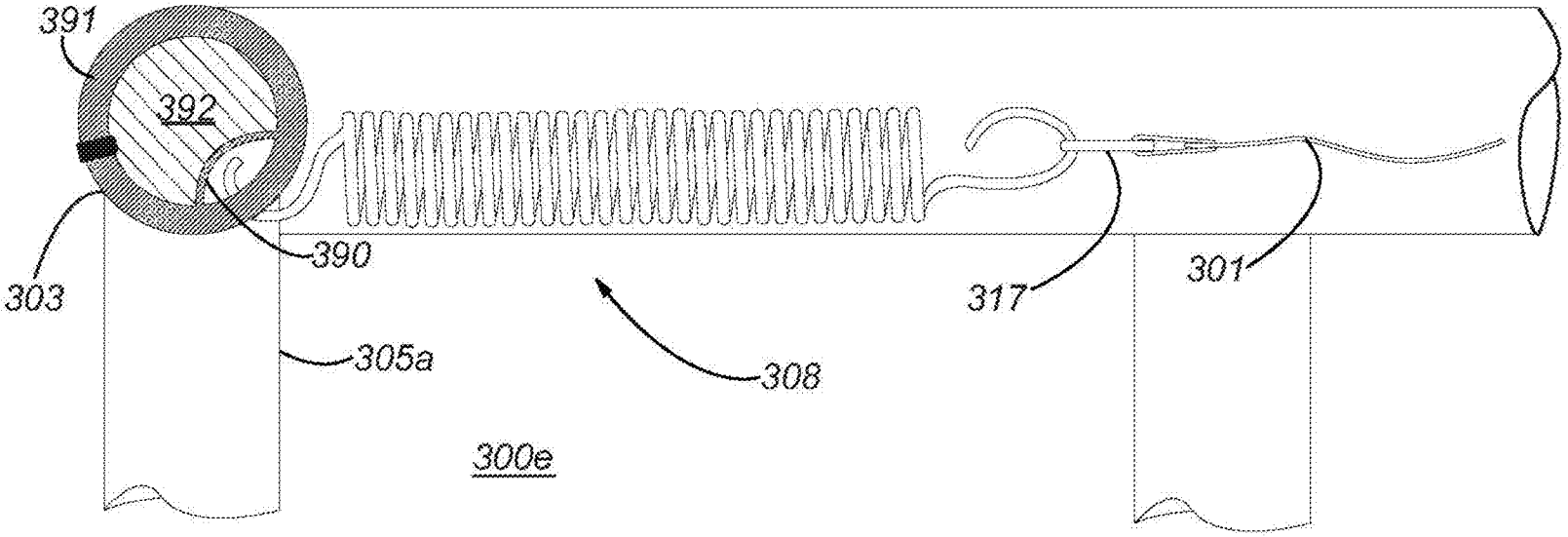
FIG. 3H illustrates a trampoline 300*e* that provides an alternative embodiment for providing a stiffer trampoline frame, according to an embodiment of the invention.

FIG. 3H illustrates a trampoline 300*e* that provides an alternative embodiment for providing a stiffer trampoline frame. In the trampoline 300*e*, the conventionally hollow frame 303 has been filled with a material 392 that increases the mass of the frame 303.

The material 392 is not typically added to the frame 303 until assembly. In addition, if the trampoline 303*e* is provided as a kit, it is possible that the material 392 may not be provided with the kit due to weight considerations.

The material 392 may be inserted into the frame 303 via an opening 391 and the material 392 may be inserted in a liquid form that dries to a solid form. Because the resilient member 308 will still need to be inserted into the frame 303, a guard 390 may be inserted into the frame 303. The guard 390 will hold an area of the frame 303 open such that the resilient member 308 may still be inserted into the frame 303. If the material 392 enters the frame in a liquid form and then dries, then the guard 390 serves its purpose primarily during the phase in which the material 392 is liquid and moveable, according to an embodiment of the invention. Alternatively, if the material 392 comprises a liquid (e.g., a high viscosity liquid) that remains in liquid form for simplified relocation of the trampoline, then the guard 390 may prevent the material 392 from leaking, according to an embodiment of the invention.

The material 392 could comprise a material known for hardening into a solid form such as concrete, plastic, solidified foam, plaster, or sealing foam. The material 392 could also comprise gravel, as well as a variety of novel materials.

Figure 4A:
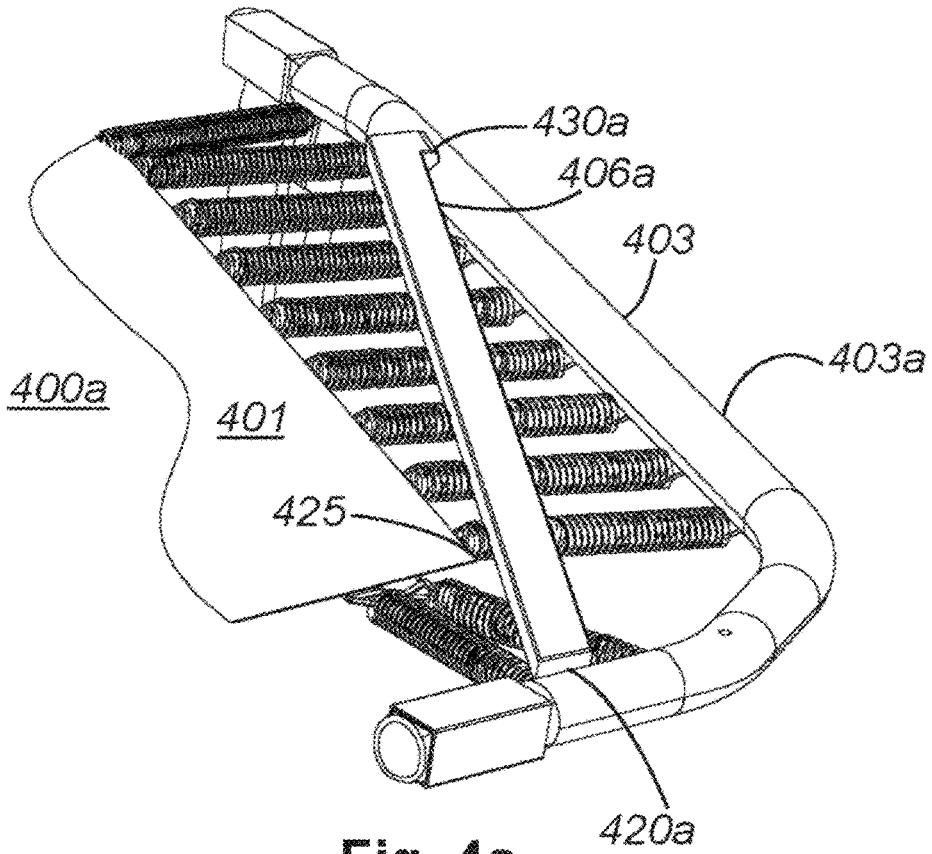
FIG. 4A illustrates a trampoline 400*a* having a support bar 406*a* to provide increased stiffness to a frame 403 of the trampoline 400*a*, according to an alternative embodiment of the invention.

FIG. 4A illustrates a trampoline 400*a* having a support bar 406*a* to provide increased stiffness to a frame 403 of the trampoline 400*a*, according to an alternative embodiment of the invention.

The trampoline 400*a* resembles the trampoline 100 shown in FIG. 1. The support bar 406*a* is attached to the frame 403 at points 420*a*, 430*a* and covers the distance between points 420*a*, 430*a* in an essentially straight manner while traversing near a corner point 425 on a flexible mat 401.

Figure 4B:
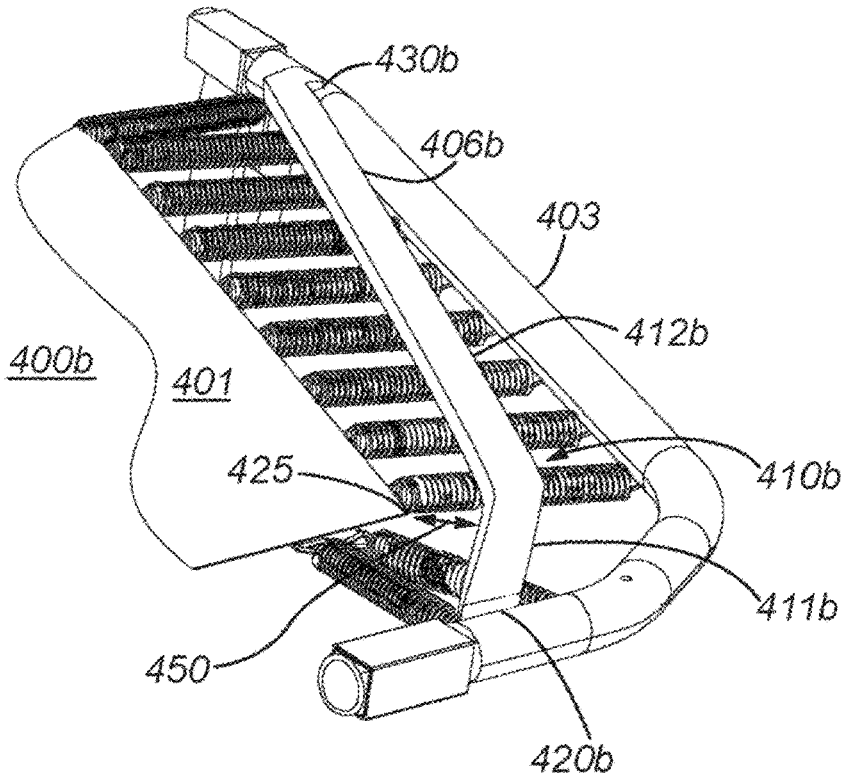
FIG. 4B illustrates a trampoline 400*b* having a support bar 406*b* to provide increased stiffness to the frame 403 of the trampoline 400*b*, according to an alternative embodiment of the invention.

FIG. 4B illustrates a trampoline 400*b* having a support bar 406*b* to provide increased stiffness to the frame 403 of the trampoline 400*b*, according to an alternative embodiment of the invention.

The trampoline 400*b* resembles the trampoline 100 shown in FIG. 1 except that the support bar 406*b* has a pronounced bend at point 410*b* where section 412*b* bends into section 411*b*. The support bar 406*b* is attached to the frame 403 at points 420*b*, 430*b* and covers the distance between points 420*b*, 430*b*. The support bar 406*b* has one portion 410*b* and a second portion 411*b* that bow outward at point 410*b* near the corner point 425 on the flexible mat 401. Thus, the support bar 406*b* bypasses the corner 425 by a distance 450.

The support bar 406*b* may provide increased safety over the support bar 406*a*, although the support bar 406*b* likely does not stiffen the frame 403 as effectively as the support bar 406*a*, according to an embodiment of the invention.

Figure 5A:
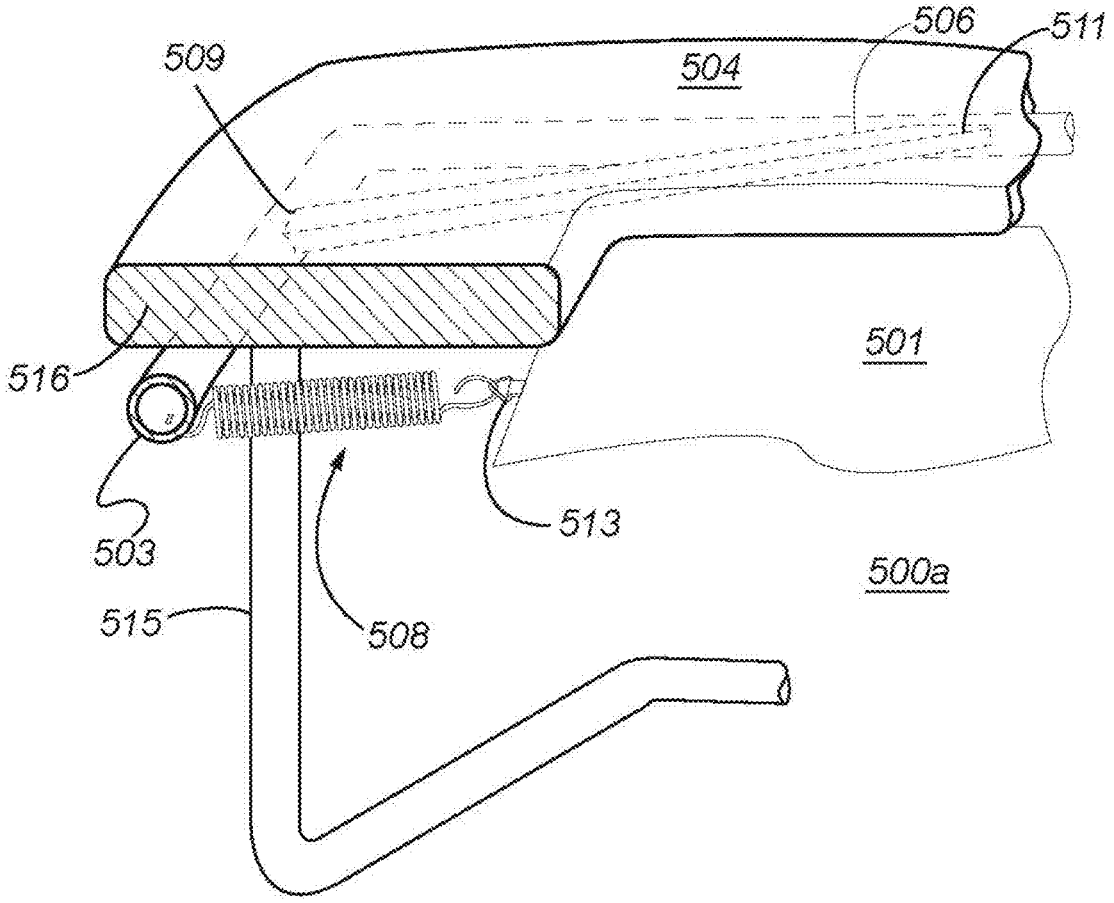
FIG. 5A illustrates a support bar 506 in a trampoline 500*a*, according to an alternative embodiment of the invention.

FIG. 5A illustrates a support bar 506 in a trampoline 500*a* having an edge pad 504, according to an alternative embodiment of the invention.

The frame 503 has a resident level of stiffness that aids the plurality of resilient members 508 in providing a suspension for the trampoline 500*a*. If the frame 503 can be made more rigid, then more of the energy input to the trampoline 500*a* will be reflected back to the users.

Attaching a plurality of support bars 506 to the frame 503 increases the stiffness of the frame 503, according to an embodiment of the invention. The support bars 506 may be placed, for example in each of the corners of a rectangular trampoline. Placing the support bar 506 over the legs 515 creates a particular zone of increased stiffness as discussed in conjunction with FIG. 3B. The support bars 506 may be attached to the frame 503 by a number of mechanisms from welding the support bars 506 to the frame 503 to bolting or screwing the support bars 506 to the frame 503.

The support bar 506 may be placed from one side 511 of the frame 503 and extend to another side 509. The precise location of the support bar 506 may vary in various embodiments of the trampoline 500*a*. One consideration is the amount of the support bar 506 that extends into the effective area of the trampoline's flexible mat 501. As a general rule, the support bar 506 should not be located so close to the flexible mat 501 that the user may land on the support bar 506 during normal trampoline use. As shown in FIG. 3A, for example, the support bar 306*a* passes tangent to a point 330*a* on the flexible mat 301.

The support bar 506 may also be used to provide support underneath the user when the user enters the trampoline 500*a*. Because of vertical support leg 515, the trampoline 500*a* typically rests at a slightly higher elevation than the floor on which the trampoline 500*a* stands. Thus, the trampoline user needs to step up and into the trampoline 500*a* in order to use it. Consequently, trampoline users may find it helpful to have a semi-solid area on which to stand when entering and exiting the trampoline 500*a*.

The support bar 506 like the frame 503 will typically be covered by an edge pad, such as edge pad 504. The edge pad 504 comprises a covering, that has been crimped or folded to facilitate the insertion of a cushioning flexible material 516 into the edge pad 504, according to an embodiment of the invention. The cover of the edge pad 504 may comprise a durable plastic flexible material while the cushioning flexible material 516 may comprise a flexible material such as foam rubber.

The edge pad 504 covers the frame 503, the support bar 506, and the trampoline suspension system comprising a resilient member 508. The resilient member 508 (e.g., a coiled spring), one member of the set of resilient members of the trampoline suspension system, attaches at one end to the frame 503 and at the other end to a D-ring 513 that itself attaches to the flexible mat 501 in a manner similar to that disclosed in conjunction with FIG. 1.

Trampoline users jump or bounce on the flexible mat 501 in a generally vertical direction and possibly also move in a horizontal direction perpendicular to the vertical. The edge pad 504 lies on top of the suspension system comprising the resilient member 508 to protect trampoline users from harm as they jump on the flexible mat 501 since they could possibly land on the suspension system and become injured. The edge pad 504 generally serves to eliminate and/or reduce the severity of impact injuries. To prevent user bodily appendages from coming into contact with the resilient members of the suspension system, the edge pad 504 should be attached to the flexible mat 501, according to an embodiment of the invention.

Figure 5B:
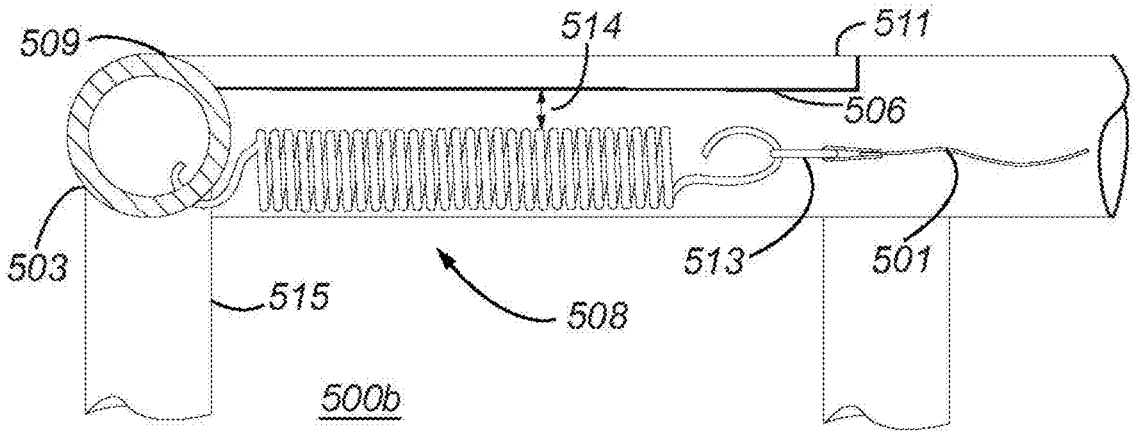
FIG. 5B illustrates a trampoline 500*b* having a support bar 506 attached a distance 514 above the resilient member 508 of the trampoline's suspension system, according to an embodiment of the invention.

FIG. 5B illustrates a trampoline 500*b* having a support bar 506 attached a distance 514 above the resilient member 508 of the trampoline's suspension system, according to an embodiment of the invention. The trampoline 500*b* resembles the trampoline 500*a* in all respects except that the edge pa 504 has been removed in FIG. 5B.

The support bar 506 is attached to the frame 503 at points 509, 511. The resilient member 508 attaches below the frame 503 and attaches to a D-ring 513 that attaches to the flexible mat 501.

As noted above, the support frame 506 resides a distance 514 above the resilient member 508. The distance 514 allows the resilient member 508 to bend and flex during normal operations without hitting the support bar 506. The distance 514 also provides greater separation between trampoline users and the plurality of resilient members 508.

Figure 6:
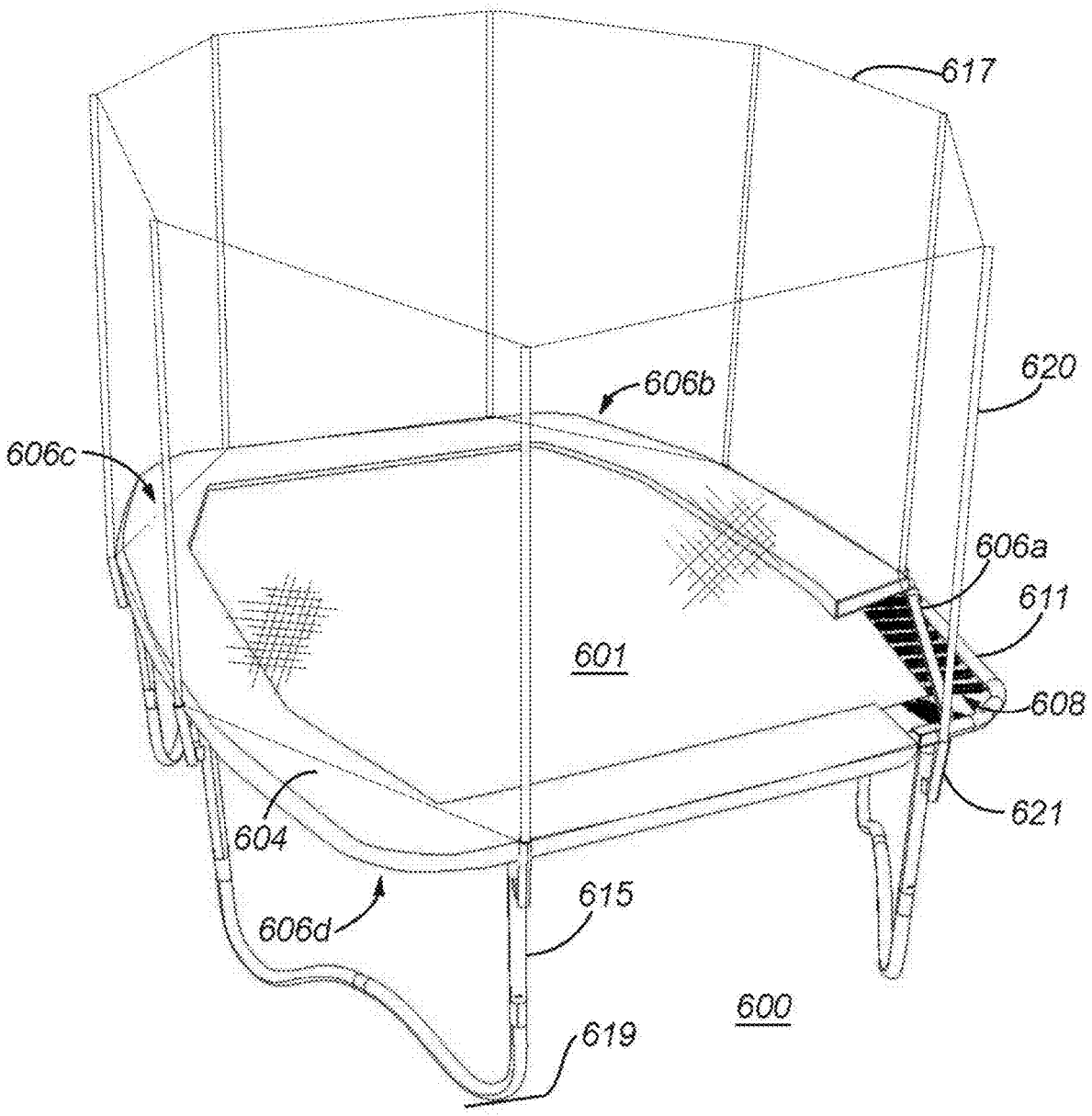
FIG. 6 illustrates a perspective view of a trampoline 600 having four corner support bars 606*a*-606*d*, according to an embodiment of the invention.

FIG. 6 illustrates a perspective view of a trampoline 600 having four corner support bars 606*a*-606*d*, according to an embodiment of the invention. A cutaway section of FIG. 6 illustrates the support bar 606*a*. The trampoline 600 comprises a flexible mat 601 and an edge pad 604.

The flexible mat 601 is encompassed by the frame 611. The frame 611 comprises legs 615, such that the trampoline 600 stands on the ground 619 via the legs 615.

Edge pad 604 covers the plurality of resilient members 608 (e.g., a coiled spring) and the frame 611 and the support bars 606*a*-606*d*. FIG. 6 shows the resilient member 608 in a cutaway of the edge pad 604.

The resilient members 608 surround the flexible mat 601 and attach to the frame 611. The edge pad 604 would normally provide a complete covering without the cutaway portion shown in FIG. 6. In the illustrated embodiment, the flexible mat 601 and the surrounding frame 611 are shown as rectangular, but they may also be e.g. oval, square, circular, or stadium-shaped.

The trampoline 600 includes a safety net 617 attached to a plurality of safety poles 620. The safety net 617 may attach to the outside edge of the edge pad 604, according to an embodiment of the invention. The safety net 617 and safety poles 620 may be configured in a manner such as disclosed in the applicants' PCT/EP2017/057961 and/or as disclosed in applicants' pending EP18154158.2 application. Both applications are incorporated herein by reference.

The safety net 617 prevents a user from falling off the flexible mat 601 and hitting the ground 619. The safety net 617 may be retained by a safety net retainer, e.g. a number of support poles 620 extending upwardly from the frame 611 for carrying the safety net 617 surrounding the flexible mat 601, according to an embodiment of the invention.

Embodiments of the invention may comprise a kit that is provided to the user in the form of a series of parts, such as a flexible mat, an edge pad, a frame (possibly in a number of pieces), a plurality of resilient members, and other components. Instructions for assembling a trampoline comprising these parts can be provided to the user.

The trampolines described herein, such as but not limited to the trampoline 600 shown in FIG. 6, particularly assembly outside of the factory where they were made such as by a user or a delivery person. The assembly can typically be accomplished by hand or with a minimum number of tools, according to an embodiment of the invention. The legs (e.g., the legs 615 shown in FIG. 6) are typically attached to the frame (e.g., the frame 611. The resilient members (e.g., the resilient members 608) may be next attached to the fame, e.g., the frame 611. The edge pad, e.g., the edge pad 604 may be next placed on top of the frame 611 and the resilient members. The safety poles 620 may be next attached to the frame, and the safety net 617 may be next attached. In some embodiments, the safety net 617 may need to be attached or placed between the flexible mat 601 and the resilient members 608 prior to the connection of the flexible may 806 and the resilient members 608, according to an embodiment of the invention.

Further, modifications of the invention within the scope of the appended claims are feasible. As such, the present invention should not be considered as limited by the embodiments and figures described herein. Rather, the full scope of the invention should be determined by the appended claims, with reference to the description and drawings.

Various embodiments of the invention have been described in detail with reference to the accompanying drawings. References made to particular examples and implementations are for illustrative purposes, and are not intended to limit the scope of the invention or the claims.

It should be apparent to those skilled in the art that many more modifications of the trampoline besides those already described are possible without departing from the inventive concepts herein. The inventive subject flexible matter, therefore, is not to be restricted except by the scope of the appended claims. Moreover, in interpreting both the specification and the claims, all terms should be interpreted in the broadest possible manner consistent with the context.

Headings and sub-headings provided herein have been provided as an assistance to the reader and are not meant to limit the scope of the invention disclosed herein. Headings and sub-headings are not intended to be the sole or exclusive location for the discussion of a particular topic.

While specific embodiments of the invention have been illustrated and described, it will be clear that the invention is not limited to these embodiments only. Embodiments of the invention discussed herein may have generally implied the use of flexible materials from certain named equipment manufacturers; however, the invention may be adapted for use with, equipment from other sources and manufacturers. Equipment used in conjunction with the invention may be configured to operate according to conventional methods and protocols and/or may be configured to operate according to specialized protocols. Numerous modifications, changes, variations, substitutions and equivalents will be apparent to those skilled in the art without departing from the spirit and scope of the invention as described in the claims. In general, in the following claims, the terms used should not be construed to limit the invention to the specific embodiments disclosed in the specification, but should be construed to include all systems and methods that operate under the claims set forth hereinbelow. Thus, it is intended that the invention covers the modifications and variations of this invention provided they come within the scope of the appended claims and their equivalents.

All publications herein are incorporated by reference to the same extent as if each individual publication or patent, application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

I claim:

1. A trampoline, comprising:

a frame having a residual stiffness that represents resistance of the frame to kinetic energy imparted by a trampoline user to the frame during operation;

a plurality of leg sections supporting the frame, wherein each leg section of a plurality of leg sections comprises a first vertical support section and a second vertical support section, the first vertical support section attached to the frame at a first point and the second vertical support section attached at a second point, and wherein the plurality of leg sections are disposed around the frame;

a plurality of support bars, wherein a number of support bars of the plurality of support bars at least equals a number of leg sections of the plurality of leg sections, wherein each support bar of the plurality of support bars has a first end and a second end, wherein the first end is attached above the first point and the second end is attached above the second point, such that each support bar is centered approximately above and aligned with a corresponding leg section of the plurality of leg sections, wherein the plurality of support bars increases stiffness of the frame by at least 2 times above the residual stiffness.

2. The trampoline of claim 1, further comprising:

a flexible mat;

a plurality of resilient members attached to the frame and to the flexible mat, wherein the plurality of resilient members receive kinetic energy from the trampoline user jumping on the flexible mat, enabling the trampoline user to be lifted above a surface of the flexible mat, wherein the plurality of resilient members are attached to the frame at a location below a location where the plurality of support bars are attached to the frame such that the plurality of resilient members avoid contact with the plurality of support bars when the trampoline user jumps on the flexible mat.

3. The trampoline of claim 2 wherein each resilient member of the plurality of resilient members comprises a helical spring.

4. The trampoline of claim 1, further comprising:

a flexible mat;

an edge pad resting on an upper surface of the frame and extending to the flexible mat, wherein the edge pad includes a flexible material that absorbs shock from the trampoline user falling on the edge pad, wherein the edge pad also covers the plurality of support bars.

5. The trampoline of claim 4, further comprising:

a plurality of poles attached to the frame, each pole of the plurality of poles extending vertically above the frame; and a safety net connected to each pole of the plurality of poles and also connected to the edge pad.

6. The trampoline of claim 1 wherein the frame has one of a substantially rectangular shape, a substantially square shape, a substantially circular shape, a substantially oval shape, and a substantially stadium shape.

7. The trampoline of claim 6 wherein the frame has one of a substantially rectangular shape and a substantially square shape, wherein corners of the frame have been rounded.

8. The trampoline of claim 1 wherein the frame is hollow.

9. The trampoline of claim 1 wherein the frame is adapted to be filled with a liquid that provides increased frame stiffness.

10. The trampoline of claim 1, further comprising:

a flexible mat;

a plurality of resilient members attached to the frame and to the flexible mat, wherein the resilient members receive kinetic energy from the trampoline user jumping on the flexible mat, enabling the trampoline user to be lifted above a surface of the flexible mat, wherein each support bar of the plurality of support bars is attached to the frame in such a manner as to form a line tangent to a corner of the flexible mat.

11. The trampoline of claim 1, further comprising:

a flexible mat;

a plurality of resilient members attached to the frame and to the flexible mat, wherein the resilient members receive kinetic energy from the trampoline user jumping on the flexible mat, enabling the trampoline user to be lifted above a surface of the flexible mat, wherein each support bar of the plurality of support bars comprises a first portion and a second portion wherein each support bar of the plurality bars angles outward towards the frame where the first portion joins the second portion at a point corresponding to a corner of the flexible mat such that the support bar of the plurality of support bars avoids contact with the corner by a predetermined distance.

12. The trampoline of claim 1 wherein at least one support bar of the plurality of support bars is attached to the frame in a manner to provide a platform for the trampoline user entering the trampoline.

13. The trampoline of claim 1 wherein a leg section of the plurality of leg sections comprises a uniform leg section.

14. The trampoline of claim 1 wherein each support bar of the plurality of support bars is attached to the frame by one of welding, soldering, bolting, screwing and hook fastening.

15. The trampoline of claim 1 wherein the plurality of support bars increases stiffness of the frame in a range from 8 to 15 times.

16. The trampoline of claim 1, further comprising:

a flexible mat;

a plurality of resilient members, wherein a first portion of the plurality of resilient members are attached to the frame and to the flexible mat, wherein a second portion of the plurality of resilient members are attached to support bars of the plurality of support bars, wherein the resilient members of the plurality of resilient members receive kinetic energy from the trampoline user jumping on the flexible mat, enabling the trampoline user to be lifted above a surface of the flexible mat.

17. The trampoline of claim 1, wherein the frame has an approximately rectangular shape having four corners, wherein the plurality of leg sections comprises four leg sections and the plurality of support bars comprises four support bars, wherein each leg section of the plurality of leg sections is attached to each side of a respective corner of the four corners of the frame, and wherein a corner support bar of the plurality of corner support bars is attached above and centered over a respective leg section of the plurality of leg sections.

18. The trampoline of claim 1, wherein the frame comprises a rectangular shape having a long side and a short side, and wherein the stiffness of the frame corresponds to a first frame bending rate at a load point p located at a proximal inside center of the short side of the frame and a second frame bending rate at a widened load q located across two support bars of the plurality of support bars attached on the short side of the frame, wherein Ratio-1 of the first frame bending rate with the two support bars of the plurality of support bars attached to the frame compared with the first frame bending rate without the two support bars of the plurality of support bars is given by:

$$\text{Ratio-1}=(L_a)^3/(L_b)^3;$$

wherein Ratio-2 of the second frame bending rate with the two support bars of the plurality of support bars attached to the frame compared with the second frame bending rate without the two support bars of the plurality of support bars is given by:

$$\text{Ratio-2}=(L_a)^4/(L_b)^4;$$

wherein $L_a$ equals a length of the short side of the frame, $L_b$ equals a length of the short side of the frame between the two support bars of the plurality of support bars attached to the short side of the frame; and wherein Ratio-1 is at least 5 and Ratio-2 is at least 8.

* * * * *